US005318053A

United States Patent [19]

Barnhart

[11] Patent Number: 5,318,053

[45] Date of Patent: Jun. 7, 1994

[54] COMPACT COSMETIC CENTER

[76] Inventor: Nicholas W. Barnhart, P.O. Box 562, Blackfoot, Id. 83221

[21] Appl. No.: 73,181

[22] Filed: Jun. 8, 1993

[51] Int. Cl.[5] ..... A45D 33/28

[52] U.S. Cl. ..... 132/297; 132/315; 132/301; 206/823

[58] Field of Search ..... 132/294, 297, 301, 314, 132/315, 316; 206/823; 224/312

[56] References Cited

U.S. PATENT DOCUMENTS

| | | | |
|---|---|---|---|
| 1,283,832 | 11/1918 | McCarroll | 132/315 |
| 1,336,216 | 4/1920 | Garbeil | 132/297 |
| 1,613,536 | 1/1927 | Rose | 132/315 |
| 1,676,012 | 7/1928 | Fascetta | 132/314 |
| 2,085,502 | 6/1937 | Lampl | 132/294 |
| 4,611,716 | 9/1986 | Sorlien | 132/316 X |

*Primary Examiner*—Robert P. Swiatek
*Attorney, Agent, or Firm*—Hopkins, French, Crockett, Springer & Hoopes

[57] ABSTRACT

A compact cosmetic center that houses cosmetic products needed to do a complete makeup application. This center securely stores replaceable cosmetic cartridges, tubes, and tools to allow the consumer hands-free use while in a stationary, upright position or when in motion, i.e., in an automobile, boat, plane. This is possible by use of suction cups attaching to nonporous surfaces or by the use of an adjustable clip for use on a desk top or car visor.

11 Claims, 4 Drawing Sheets

COMPACT COSMETIC CENTER

BACKGROUND OF THE INVENTION

1. Field of the Invention

This invention relates to a compact cosmetic case containing replaceable cosmetic cartridges, tubes, and applicators.

2. Description of the Prior Art

Various portable cosmetic and toilet article cases have been disclosed that carry women's or men's cosmetic articles. U.S. Pat. No. 1,613,536 discloses a toilet article case that has a plurality of pockets, a mirror, and a folding hinged cover for use by aviators, barbers, and traveling men. U.S. Pat. No. 1,828,863 discloses a woman's vanity case for carrying lipsticks, perfume, eyebrow pencils, mirrors, and similar toilet articles and has folding hinged lids. U.S. Pat. No. 5,163,457 discloses a cosmetic case having a slidable cover with a window, a mirror, a cosmetic well, and a brush applicator. It has a tubular storage space for refill tubular products like lipstick.

SUMMARY OF THE INVENTION

It is the purpose of this invention to offer a cosmetic center that offers complete consolidation of products and accessories. Rather than offering a few random products, this center offers all products needed to do a complete application, with ability to let the user install a variety of replacement products.

It is a further purpose of this invention to provide access to tubular products by a hinged top on a sliding cover. The sliding cover is removable to provide access to various cosmetic powders, brushes, and mirror. A novel tongue and groove feature holds the replaceable cosmetic containers within the case.

Generally speaking, what is disclosed is:

- a body having a front portion, a back portion, a bottom, a top, and a pair of sides;
- a pair of suction cups removably affixed to the back portion;
- a clip removably affixed to the body bottom;
- a plurality of apertures on the body top that can contain cosmetic articles;
- a cavity on the front portion of the body having a pair of raised tongues;
- a mirror affixed in the cavity;
- a plurality of cosmetic accessory holding means in the cavity;
- a plurality of replaceable and interchangeable cartridges slidably affixed within the cavity by the raised tongue that engages a groove in a cartridge bottom surface; and
- a removable sliding cover having a hinged top cap on a top portion thereby providing access to the cosmetic articles, said cover having an open face on a back portion and a closed face on a front portion, wherein the cover may be installed having the closed face over the cavity and also having the open face over the cavity.

Other objects, advantages, and capabilities of the present invention will become more apparent as the description proceeds.

BRIEF DESCRIPTION OF THE DRAWINGS

The invention may be better understood and further advantages and uses thereof may become more readily apparent when considered in view of the following detailed description of the exemplary embodiments, taken with the accompanied drawings, in which.

DETAILED DESCRIPTION OF THE PREFERRED EMBODIMENTS

Figure 1:
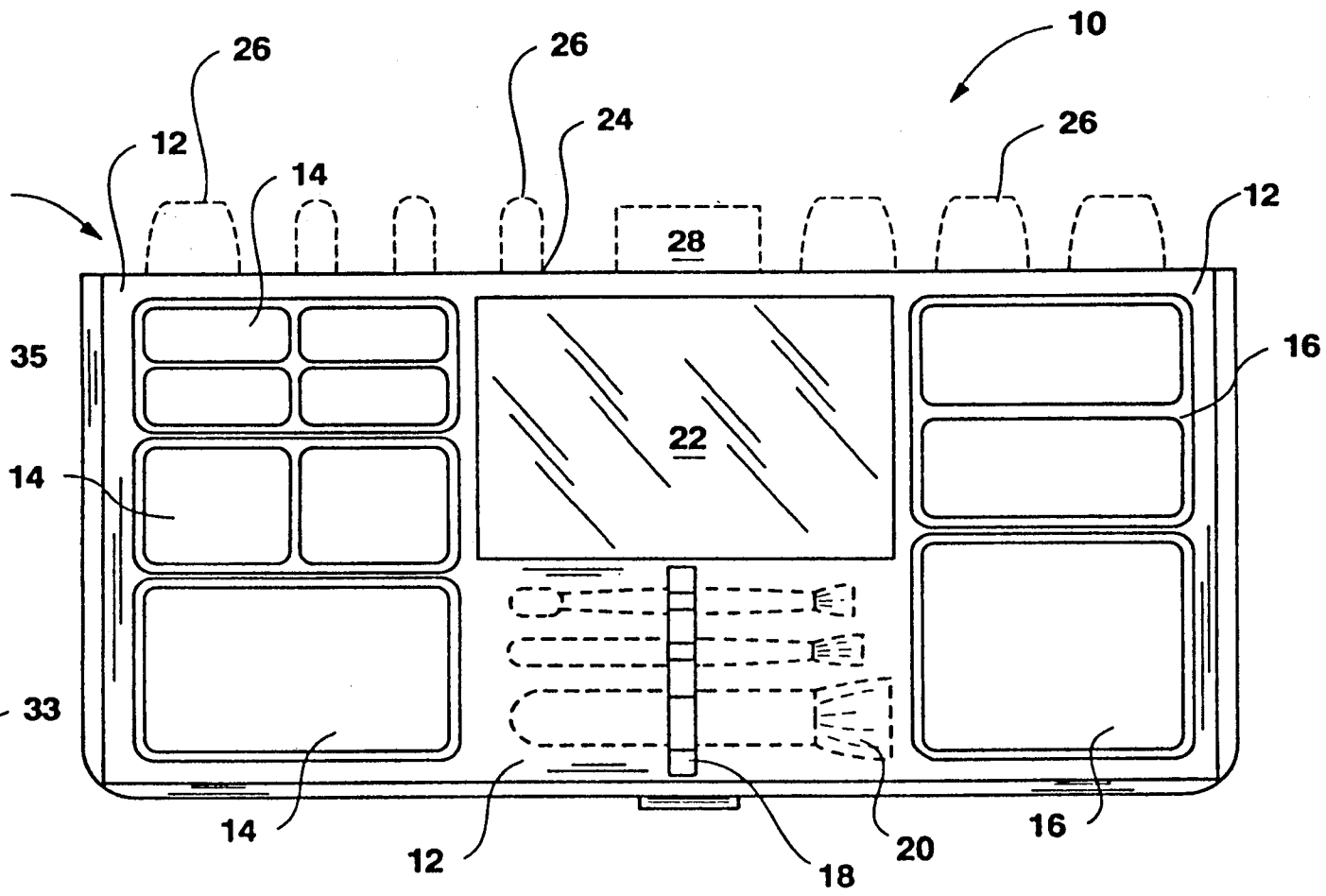
FIG. 1 is a front view of the compact cosmetic center.

The cosmetic compact center or case will be described by referring to FIGS. 1-5. In FIG. 1, the compact cosmetic center 10 is illustrated with a cover removed providing access to the cavity 12 containing a plurality of smaller cosmetic cartridges 14 and larger cartridges 16. It should be noted that the three smaller cartridges are the same size and shape and, therefore, interchangeable. Larger cartridges 16 are also interchangeable, i.e., top for bottom locations. These cartridges are also replaceable as will be described later. The cavity 12 also contains a plurality of cosmetic accessory holding means 18 that contain typical cosmetic tools, such as brushes 20 (shown in phantom).

Also mounted within the cavity 12 is a mirror 22 and across the top of body is a plurality of apertures 24 containing a plurality of tubes 26 and a pad 28 (shown in phantom).

Figure 2:
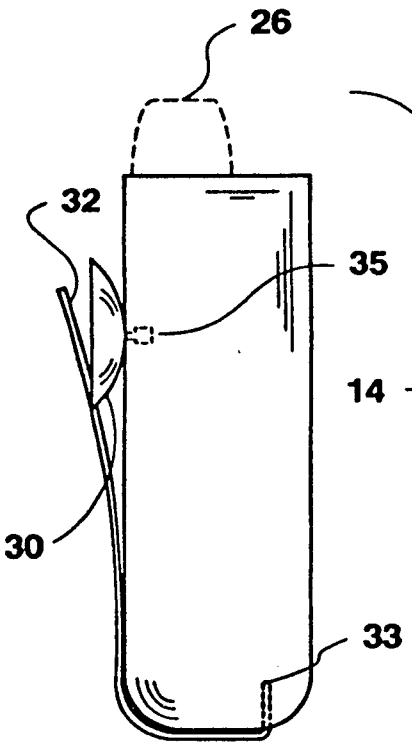
FIG. 2 is a side view of the center.

Referring now to the side view of FIG. 2, one of the two suction cups 30 is seen adjacent the spring clip 32. Both the cups 30 and the clip 32 can be removed from body 34, depending on how the center is to be mounted or held. For instance, the clip 32 would be slid down from the retaining aperture 33 to use the suction cups to mount the center 10 on a non-porous surface. The suction cups 30 would be removed if the cover 42 of FIG. 4 were removed, rotated 180° and slid over the back 38 of body 34. The suction cups 30 would also be removed from aperture 35 if the clip 32 was to be clipped on a car sun visor.

Figure 3:
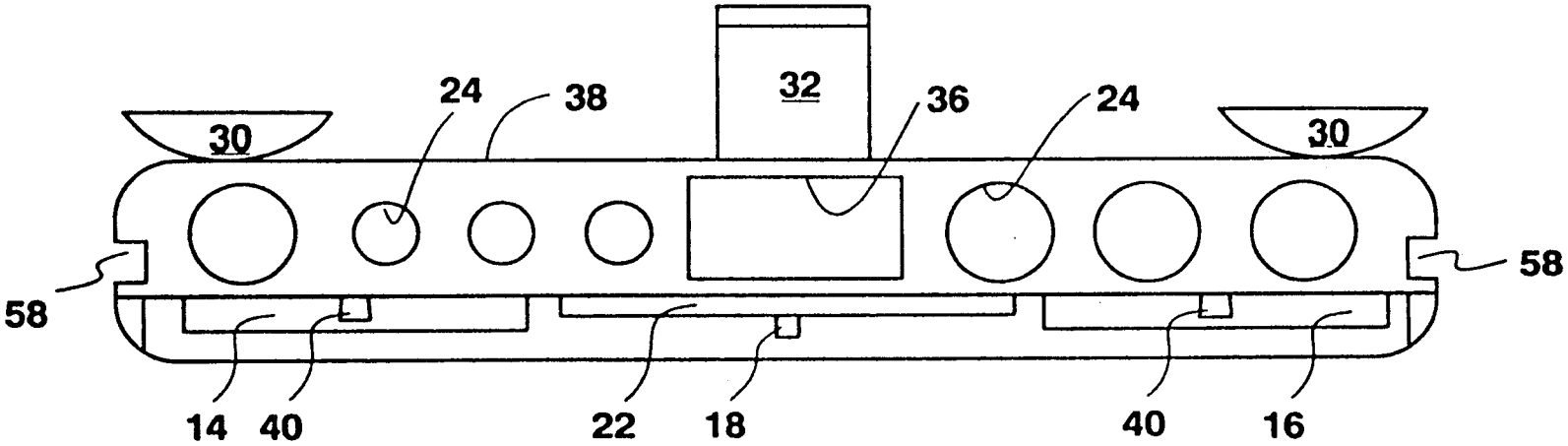
FIG. 3 is a top view of the center.

Referring now to FIG. 3 top view (with the cover removed), the plurality of circular apertures 24 of varying sizes can be seen. The rectangular pad holder aperture 36 is centered in the top. The location of the suction cups 30 and clip 32 on the back 38 is illustrated. In this view, we can see an edge view of a tongue and groove 40 that affixes the cartridges 14 and 16 by means of a slot in the cartridges engaging a raised cartridge tongue in the body cavity 12 as will be explained later.

Figure 4:
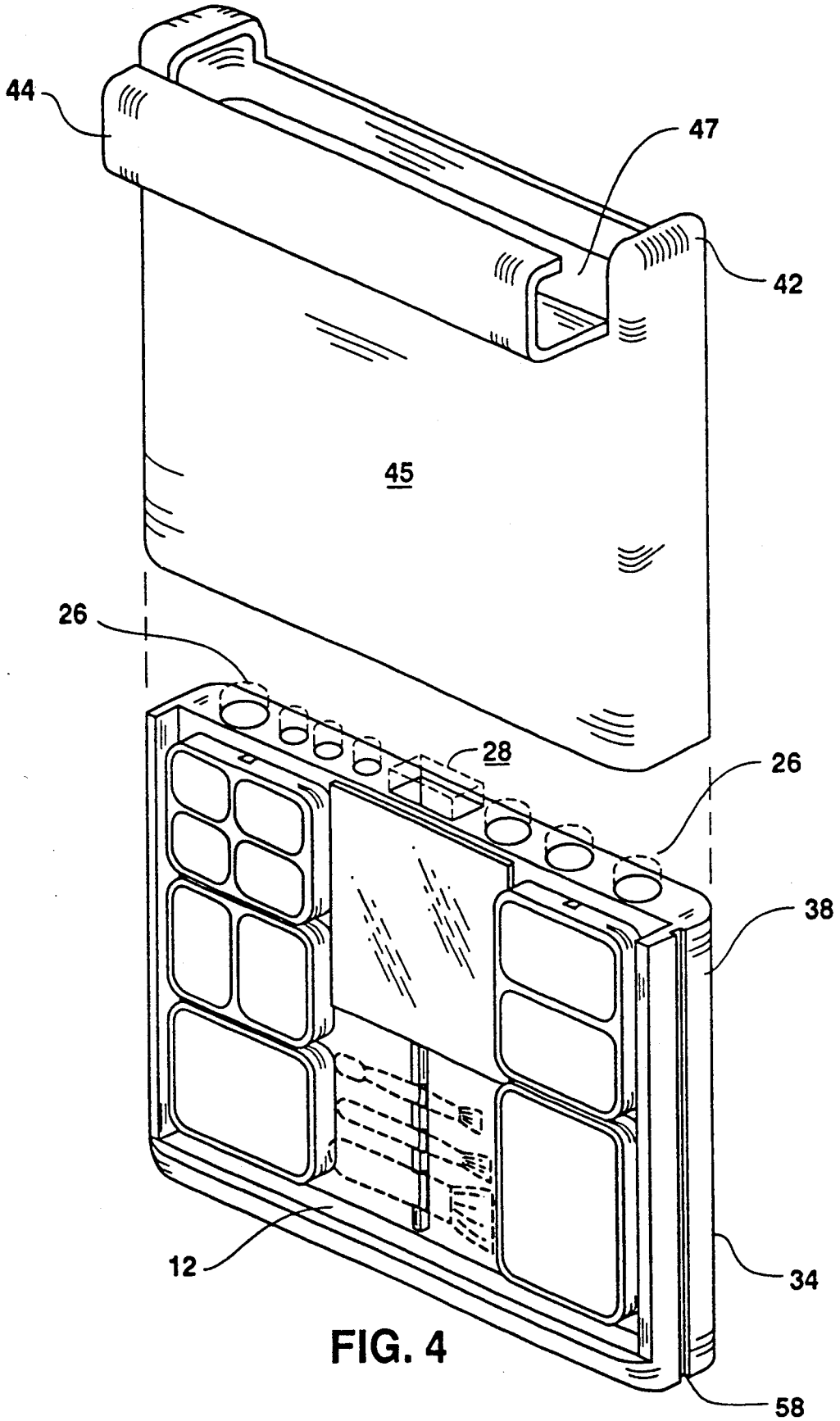
FIG. 4 is a front perspective view of the center and cover.

In perspective view of FIG. 4, the hinged cover 42 is shown raised above body 34 giving access to all cartridges, tools, and lipsticks within cavity 12. If cover 42 is installed over the body 34, access to lipsticks 26 and pad 28 is possible by opening hinged top cap 44. The front 45 of cover 42 is a closed face, whereas the back is an open face as at 47.

Figure 5:
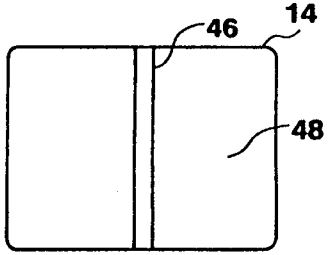
FIG. 5 is a bottom view of a compatible cartridge.
Figure 6:
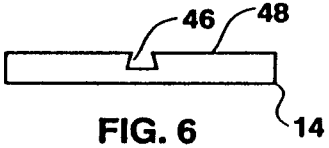
FIG. 6 is a side view of the compatible cartridge.

Bottom view FIG. 5 of a typical cartridge illustrates the groove 46 in the cartridge bottom surface 48. FIG. 6 side view shows a profile of the groove 46 in the bottom surface 48 of the cartridge.

Figure 7:
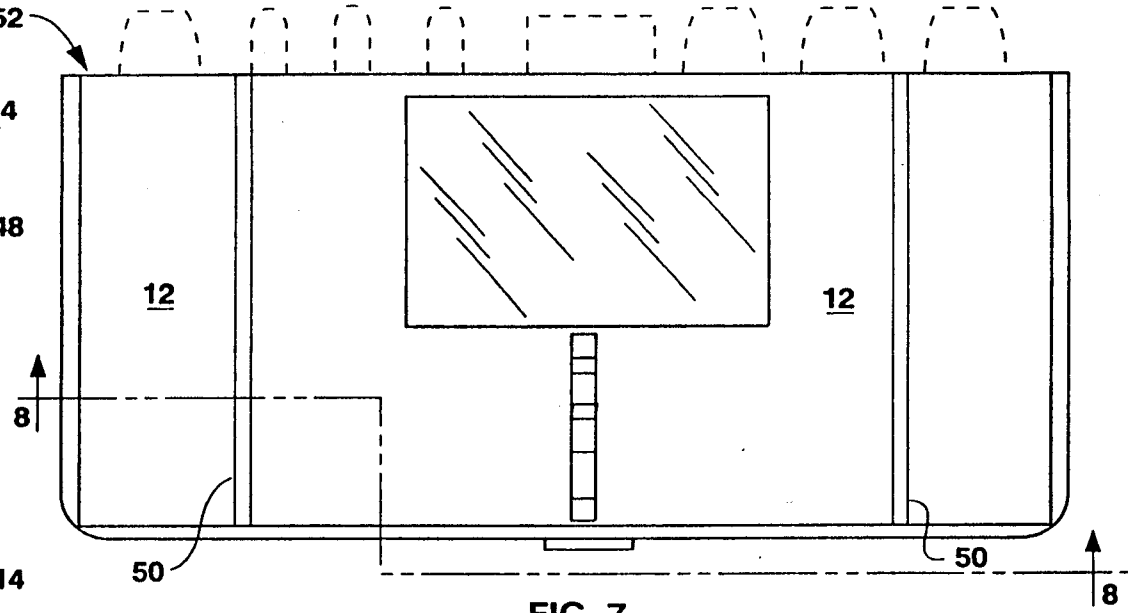
FIG. 7 is a front view of the center without the compatible cartridges or makeup tools.
Figure 8:
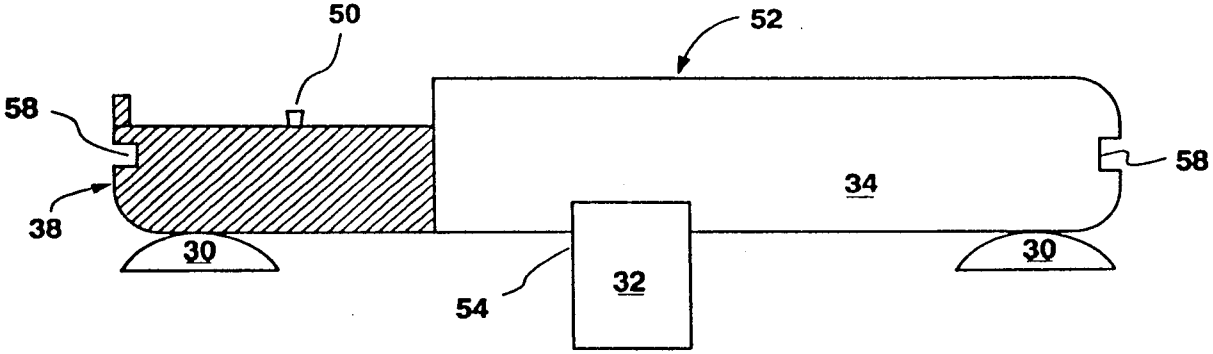
FIG. 8 is a side section view taken along lines 8—8 of FIG. 7.

Referring now to FIGS. 7 and 8, the cavity 12 has a pair of raised tongues 50 that engage the inside surface of the cartridge groove 46 and slidably restrain, by friction, the cartridge 14 or 16 within the cavity. The cartridges 14 and 16 can be replaced by sliding the cartridges up and off the raised tongue 50 while cover 42 is removed.

Figure 9:
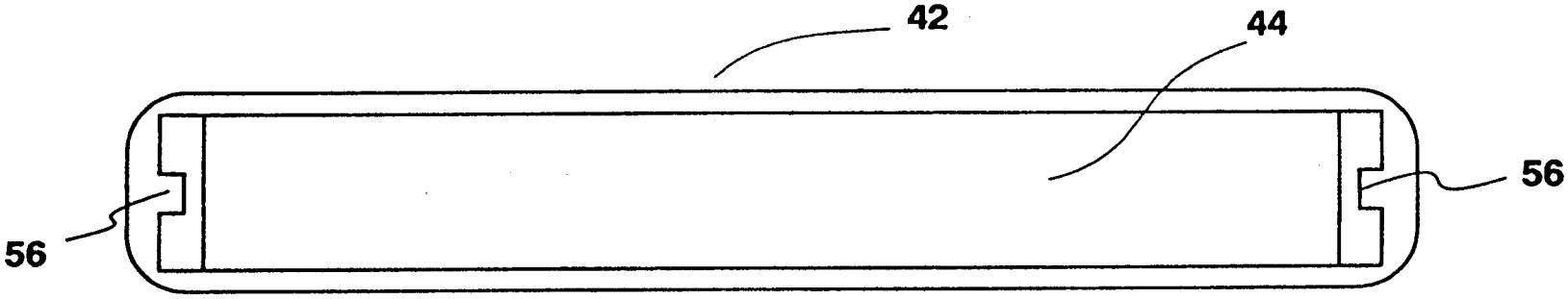
FIG. 9 is a bottom view of the cover.

Cover 42, after removal from the top 52 of the body 34, can be inserted and stored on the body by reversing and sliding the cover 42 onto the body, thereby engaging the raised square track 56 (FIG. 9) with body slot 58 of FIG. 3 (after removing the cups 30 and clip 32). This keeps body parts together, i.e., body 34 and cover 42. Slot 58 and raised track 56 are centered between the front and back of the body 34 and cover 42, thereby allowing the open face 47 to be adjacent the cavity 12 and cartridges for access or the cover can be reversed to have the closed face 45 over the cartridges, etc.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

What is claimed is:

1. A compact cosmetic center comprising:
   a. a body having a front portion, a back portion, a bottom, a top, and a pair of sides;
   b. a pair of suction cups removably affixed to the back portion;
   c. a clip removably affixed to the body bottom;
   d. a plurality of apertures on the body top that can contain cosmetic articles;
   e. a cavity on the front portion of the body having a pair of raised tongues;
   f. a mirror affixed in the cavity;
   g. a plurality of cosmetic accessory holding means in the cavity;
   h. a plurality of replaceable and interchangeable cartridges slidably affixed within the cavity by the raised tongue that engages a groove in a cartridge bottom surface; and
   i. a removable sliding cover having a hinged top cap on a top portion thereby providing access to the cosmetic articles, said cover having an open face on a back portion and a closed face on a front portion, wherein the cover may be installed having the closed face over the cavity and also having the open face over the cavity.

2. The cosmetic case of claim 1 wherein the cosmetic articles that may be contained in the plurality of apertures are lipsticks, cover sticks, makeup pencils, and a makeup pad.

3. The cosmetic case of claim 2 wherein there are seven circular apertures in top and one rectangular aperture that holds the makeup pad.

4. The cosmetic case of claim 1 wherein the cosmetic accessory holding means can affix a plurality of makeup tools.

5. The cosmetic case of claim 1 wherein the removable sliding cover has a pair of raised square tracks that engage a pair of square slots on a pair of sides of the body, thereby slidably affixing the cover to the body.

6. The cosmetic case of claim 1 wherein there are three interchangeable cartridges adjacent a first side of the mirror and two interchangeable cartridges adjacent a second side of the mirror.

7. A compact cosmetic center comprising:
   a. a body having a front portion a back portion, a bottom, a top, and a pair of sides;
   b. a pair of suction cups removably affixed to the back portion;
   c. a clip removably affixed to the body bottom;
   d. a line of eight apertures on the body top that can contain cosmetic articles;
   e. a cavity on the front portion of the body having a pair of raised tongues;
   f. a mirror affixed in the cavity centered between the pairs of tongues;
   g. a plurality of three cosmetic accessory holding means in the cavity for securing makeup brushes;
   h. a plurality of replaceable and interchangeable cartridges slidably affixed within the cavity by the raised tongue that engages a groove in a cartridge bottom surface; and
   i. a removable sliding cover having a hinged top cap on a top portion thereby providing access to the cosmetic articles, said cover having an open face on a back portion and a closed face on a front portion, wherein the cover may be installed having the closed face over the cavity and also having the open face over the cavity.

8. The cosmetic center of claim 7 wherein the cosmetic articles that may be contained in the plurality of apertures are lipsticks, cover sticks, makeup pencils, and a makeup pad.

9. The cosmetic case of claim 8 wherein there are seven circular apertures in the body top and one rectangular aperture that holds the makeup pad.

10. The cosmetic center of claim 7 wherein the removable sliding cover has a pair of raised square tracks that engage a pair of square slots on a pair of sides of the body, thereby slidably affixing the cover to the body.

11. The cosmetic case of claim 7 wherein there are three interchangeable cartridges adjacent a first side of the mirror and two interchangeable cartridges adjacent a second side of the mirror.

* * * * *